US008301057B2

(12) United States Patent
Agnissey et al.

(10) Patent No.: US 8,301,057 B2
(45) Date of Patent: Oct. 30, 2012

(54) ROLLER SEPARATION CAM WITH AUTOMATIC ENGAGEMENT

(75) Inventors: Kevin Agnissey, Lexington, KY (US); Brian Lester Boettcher, Versailles, KY (US); Darin Michael Gettelfinger, Lexington, KY (US); Michael Craig Leemhuis, Nicholasville, KY (US)

(73) Assignee: Lexmark International, Inc., Lexington, KY (US)

( * ) Notice: Subject to any disclaimer, the term of this patent is extended or adjusted under 35 U.S.C. 154(b) by 183 days.

(21) Appl. No.: 12/688,539

(22) Filed: Jan. 15, 2010

(65) Prior Publication Data

US 2011/0044722 A1 Feb. 24, 2011

Related U.S. Application Data

(60) Provisional application No. 61/235,530, filed on Aug. 20, 2009.

(51) Int. Cl.
*G03G 21/18* (2006.01)
*G03G 15/02* (2006.01)

(52) U.S. Cl. ..... 399/115; 399/176

(58) Field of Classification Search ..... 399/115, 399/174, 176, 100; 347/140
See application file for complete search history.

(56) References Cited

U.S. PATENT DOCUMENTS 5,638,158 A 6/1997 Sanpe et al.
5,666,608 A * 9/1997 Christensen ..... 399/176
5,839,029 A * 11/1998 Kataoka et al. ..... 399/115
6,385,416 B1 5/2002 Horikawa et al.
6,665,507 B1 * 12/2003 Hooper et al. ..... 399/115 X
6,817,611 B2 11/2004 DiRamio
6,882,813 B2 * 4/2005 Lee ..... 399/176 X
7,142,794 B2 * 11/2006 Fujita et al. ..... 399/100
7,448,624 B2 11/2008 Lee
7,455,295 B2 11/2008 Marx et al.
7,457,559 B2 * 11/2008 Kurita et al. ..... 399/100
7,621,528 B2 11/2009 Hara
2006/0071419 A1 4/2006 Lee
2007/0138732 A1 6/2007 Hackney
2007/0228647 A1 10/2007 Hara

OTHER PUBLICATIONS

Non-Final Office Action for U.S. Appl. No. 13/074,909, dated Nov. 14, 2011.

* cited by examiner

*Primary Examiner* — Sandra Brase

(57) ABSTRACT

A printer cartridge is provided that allows a charge roller to be separated from a photoconductive drum when the printer cartridge is not used within an image forming device. The printer cartridge includes the photoconductive drum, the charge roller, and a separating member having a resilient member disposed thereon with the separating member being disposed on the charge roller. The separating member engages and disengages the photoconductive drum in a first position and in a second position. The first position provides a spaced relationship between the charge roller and the photoconductive drum and the second position provides an engaged relationship between the charge roller and the photoconductive drum. The printer cartridge also includes the photoconductive drum disposed adjacent to the charge roller in an offset orientation that includes a centerline of a charge roller shaft offset by a predetermined distance from a centerline of a photoconductive drum shaft.

21 Claims, 5 Drawing Sheets

ROLLER SEPARATION CAM WITH AUTOMATIC ENGAGEMENT

CROSS REFERENCE TO RELATED APPLICATION

This patent application is related to and claims priority from U.S. Patent Application Ser. No. 61/235,530, filed Aug. 20, 2009, entitled "Imaging Device and Method for Making and Operating Same" and assigned to the assignee of the present application, the content of which is hereby incorporated by reference herein in its entirety.

BACKGROUND

1. Field of the Invention

The present invention generally relates to printer cartridges that are used within image forming devices, and more particularly to a cam device that separate rollers within the printer cartridge in non-operating conditions.

2. Description of the Related Art

Mono and color laser printers use a charge roller with an electrically conductive coating to create a uniform charge on the photoconductive drum. A laser is then used to discharge portions of this photoconductive drum surface in order to form a latent image thereon. The charge on the surface of the photoconductive drum that is exposed by the laser is reduced, allowing toner to adhere. This toner is then transferred to a print medium and subsequently gets melted thereon by a fuser to create a printed image.

A charge roller needs to be pressed against the photoconductive drum in order to create an initial uniform charge on the photoconductive drum. However, if the charge roller and the photoconductive drum are allowed to remain in contact for extended periods of time chemicals in the charge roller can migrate on the surface of the photoconductive drum causing print defects. This may occur when aftermarket units are stored for months before shipment to customers. Extended storage may also create a compression line on the charge roller which can lead to defects. Thus, it is desired that the charge roller is separated from the photoconductive drum until they are ready to be used.

Some manufacturers solve this problem by installing a separator sheet between the charge roller and the photoconductive drum. Others use a throw away wedge that lifts the charge roller off the photoconductive drum. In both these cases, the customer must remove these items before using the printer. Failing to remove these items or touching nearby parts in the printer may lead to machine malfunction and customer dissatisfaction.

In addition to separator sheets or wedges, some manufacturers have used cam devices. These cam devices are designed to provide interference fit between the cam and charge roller shaft to prevent the cam from engaging during vibration or drop conditions. However, such interference fit can cause noise or squealing during normal printing operations and this further reduces the reliability of the cam. Further, any radial interference between the cam and the charge roller shaft can create a frictional drag such that the charge roller stalls or slips against the photoconductive drum which can cause print defects.

Thus, there is a need to provide a mechanism that addresses at least some of the above problems yet provide a reliable separation between the charge roller shaft and the photoconductive drum.

SUMMARY OF THE INVENTION

Disclosed herein is a printer cartridge for an image forming device that includes a photoconductive drum disposed within the printer cartridge and having a shaft that rotates about a rotational axis and a centerline orthogonal to the rotational axis of the shaft, a charge roller having a shaft that rotates about a rotational axis and a centerline orthogonal to the rotational axis of the shaft, the charge roller disposed adjacent to the photoconductive drum in an orientation that includes the centerline of the charge roller offset by a predetermined distance from the centerline of the photoconductive drum, and a separating member rotatably disposed on each end of the charge roller shaft and having a resilient member disposed thereon, the separating member engaging the photoconductive drum in a first position to provide a spaced relationship between the charge roller and the photoconductive drum and the separating member disengaging the photoconductive drum in a second position to engage the charge roller with the photoconductive drum, the resilient member contacting a portion of the photoconductive drum in the first position and being separated from the photoconductive drum in the second position.

In some embodiments, the printer cartridge includes a projection extending from an outer surface and receiving at least a portion of the resilient member, and a central opening for receiving an end of the charge roller shaft, the shaft is free to rotate within the central opening.

In another embodiment, the separating member further includes an outer surface having a protruding portion and disposed adjacent to the wiper, the protruding portion engages a portion of the top surface of the wiper in the first position of the resilient member and disengages from the top surface in the second position.

In another aspect, a method for separating a charge roller and a photoconductive drum within a printer cartridge includes providing a charge roller having a shaft that rotates about a rotational axis and a centerline orthogonal to the rotational axis, disposing a rotatable separating member having an outer surface for retaining a resilient member on each end of the charge roller shaft, disposing a photoconductive drum having a shaft that rotates about a rotational axis and a centerline orthogonal to the rotational axis, the photoconductive drum disposed adjacent to the charge roller in an orientation that includes the centerline of the charge roller shaft offset by a predetermined distance from the centerline of the photoconductive drum shaft, and positioning the separating member on the photoconductive drum in a first position to provide a spaced relationship between the charge roller and the photoconductive drum with the resilient member contacting a portion of the photoconductive drum, the resilient member capable of being separated from the photoconductive drum by positioning the separating member in a second position, the second position engaging the charge roller with the photoconductive drum.

In some embodiments, a first rotation of the photoconductive drum allows the resilient member to turn the separating member to the second position.

In yet another aspect, a separating member for separating a photoconductive drum and a charge roller in a printer cartridge includes a central opening for receiving a charge roller shaft, the charge roller shaft disposed to freely rotate within the central opening, an outer surface disposed at a distance and around the central opening, the outer surface including a projection extending from the outer surface and having a protruding portion oppositely disposed to the projection, and a resilient member disposed on the projection and capable of contacting the photoconductive drum in a first position of the separating member, the first position capable of providing a spaced relationship between the photoconductive drum and the charge roller.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description of the present embodiments of the invention and are intended to provide an overview or framework for understanding the nature and character of the invention as it is claimed. The accompanying drawings are included to provide a further understanding of the invention and are incorporated into and constitute a part of this specification. The drawings illustrate various embodiments of the invention and together with the description serve to explain the principles and operation of the invention.

BRIEF DESCRIPTION OF THE DRAWINGS

The above-mentioned and other features and advantages of the various embodiments of the invention, and the manner of attaining them, will become more apparent and will be better understood by reference to the accompanying drawings, wherein.

DETAILED DESCRIPTION

Figure 1:
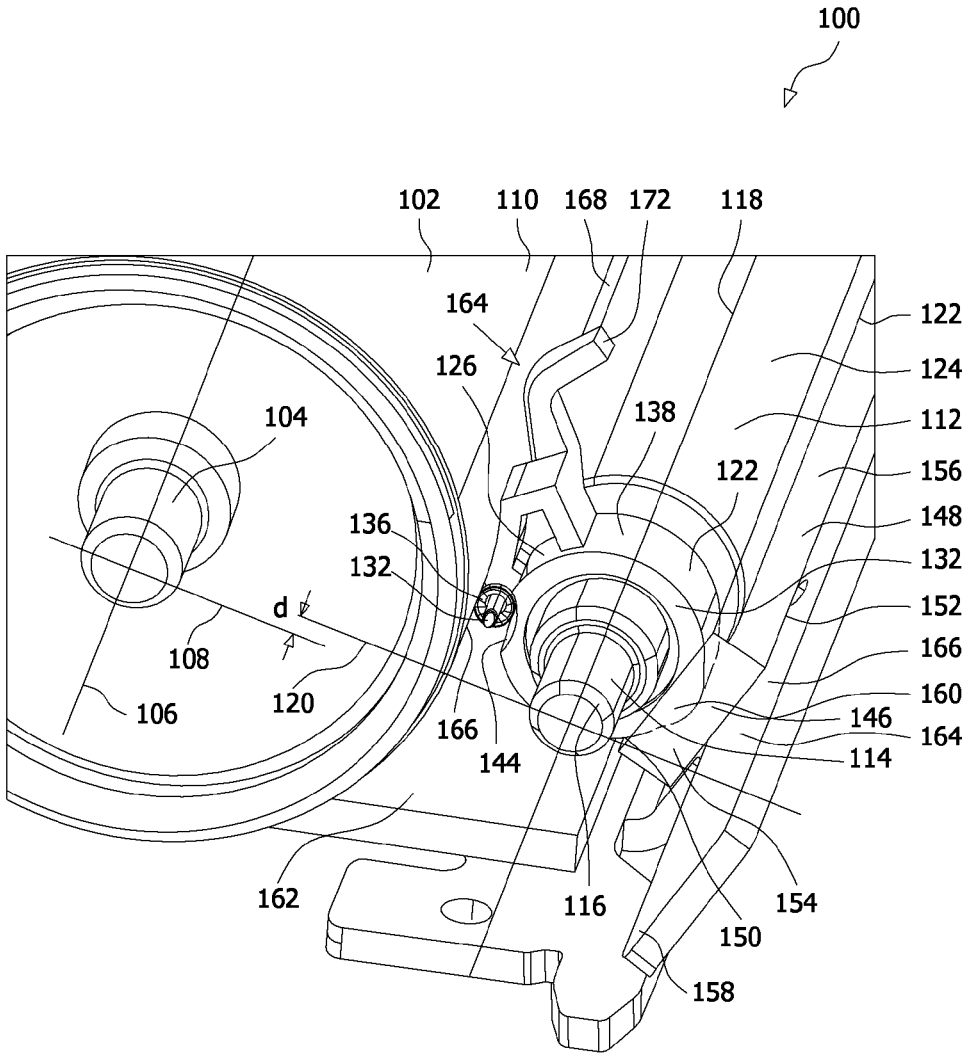
FIG. 1 is a partial perspective view of one embodiment of a printer cartridge showing relationship between a separating member, a charge roller, and a photoconductive drum disposed within the printer cartridge according to the present invention.

Reference will now be made in detail to the exemplary embodiment(s) of the invention, as illustrated in the accompanying drawings. Whenever possible, the same reference numerals will be used throughout the drawings to refer to the same or like parts.

Figure 2A:
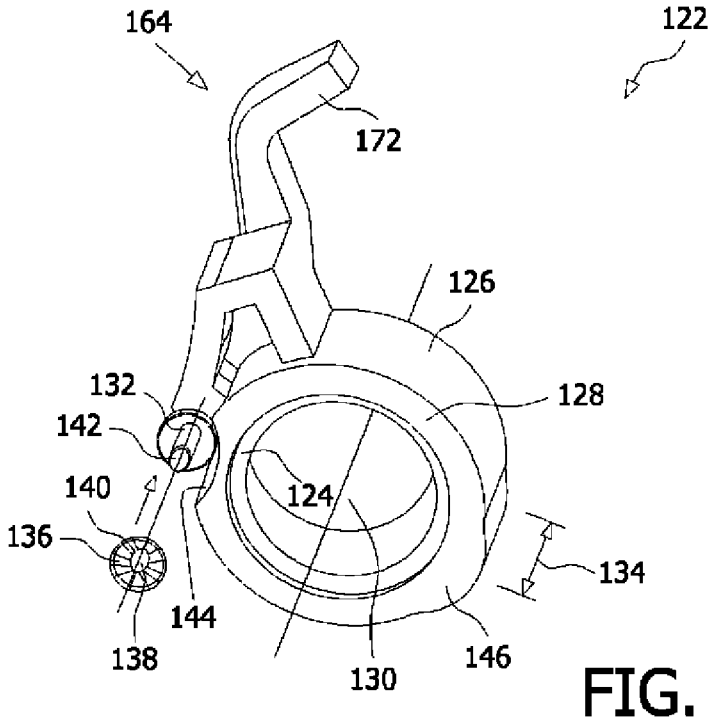
FIG. 2*a* shows an exploded perspective view of one embodiment of the separating member according to the present invention.
Figure 2B:
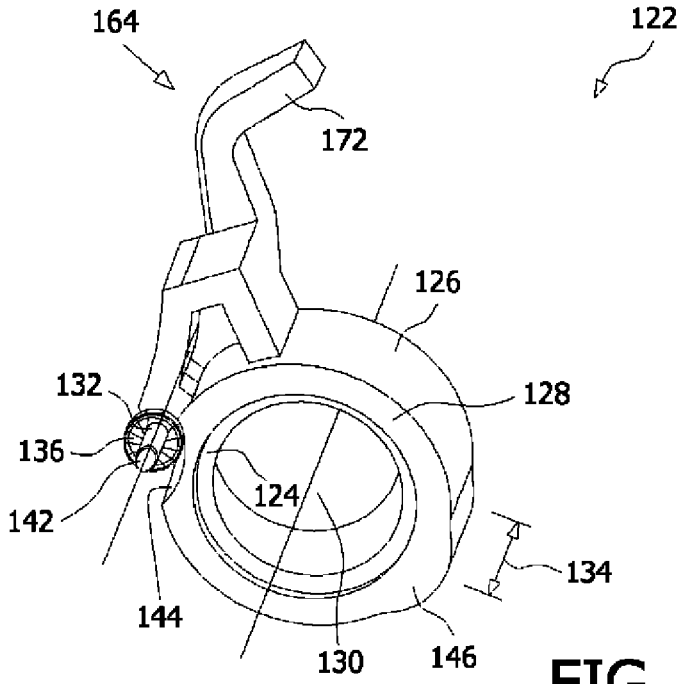
FIG. 2*b* is an assembled perspective view of the separating member of FIG. 2*a* according to the present invention.
Figure 3:
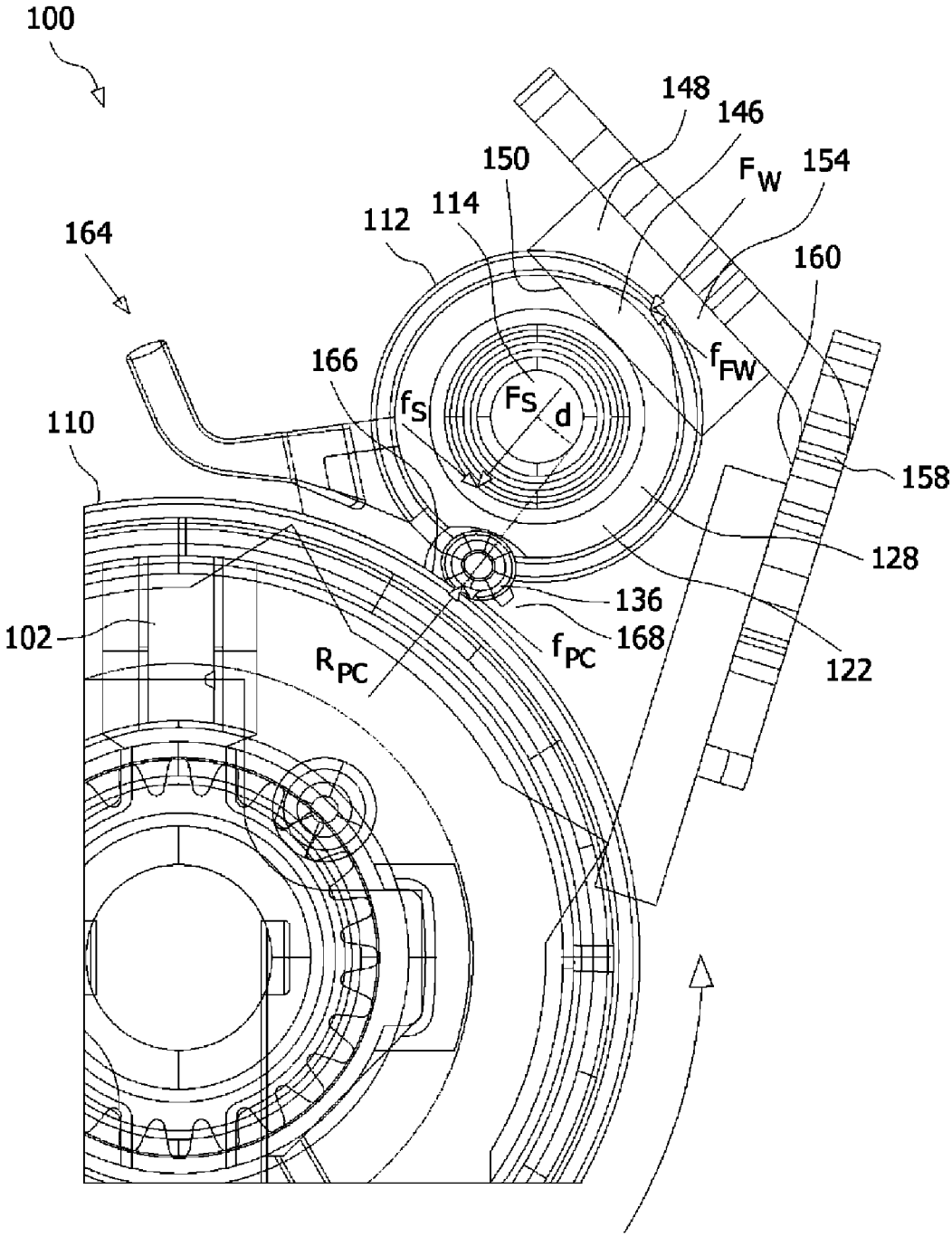
FIG. 3 is an elevational view of the separating member of FIG. 1 in a first position.

FIGS. 1-3 illustrate an embodiment of a printer cartridge 100 that may be used within an electrophotographic imaging forming device for example, a laser printer (not shown) according to the present invention. The printer cartridge 100 includes a photoconductive drum 102 disposed within the printer cartridge 100. A photoconductive drum shaft 104 that extends between its two ends is received within the photoconductive drum 102. The photoconductive drum shaft 104 has a rotational axis 106 about which the photoconductive drum shaft 104 rotates when electrically coupled with the image forming device. The photoconductive drum shaft 104 also has a centerline 108 orthogonal to the rotational axis 106. The photoconductive drum 102 further includes an outer surface 110 that may be charged to a uniform potential when contacted with a charge roller 112.

The charge roller 112, as shown in FIGS. 1-3, is disposed adjacent to the photoconductive drum 102 within the printer cartridge 100. The charge roller 112 has a charge roller shaft 114 that extends from a first end 116 to a second end (not shown) and received within the charge roller 112. The charge roller shaft 114 has a rotational axis 118 along which the charge roller shaft 114 rotates when electrically coupled with the image forming device. The charge roller shaft 114 also has a centerline 120 orthogonal to the rotational axis 118 of the charge roller shaft 114. Further, the charge roller 112 also has an outer surface (not shown) that may contact an outer surface 110 of the photoconductive drum 102. The charge roller 112 contacts the outer surface 110 of the photoconductive drum 102 when the printer cartridge 100 is operated inside the image forming device.

On both the first end 116 and the second end of the charge roller shaft 114, a separating member 122 is disposed. In one embodiment, the separating member 122 is rotatably mounted on the charge roller shaft 114 in a manner that allows the charge roller shaft 114 to freely rotate within the separating member 122. As shown in FIGS. 2*a* and 2*b*, the separating member 122 includes an inner surface 124, an outer surface 126, a thickness 128 extending between the inner surface 124 and the outer surface 126, and a central opening 130. The central opening 130 of the separating member 122 receives the first end 116 of the charge roller shaft 114 so as to mount the separating member 122 on the charge roller shaft 114. In an embodiment, the separating member 122 that is mounted on the charge roller shaft is a cam.

As shown in FIGS. 2*a* and 2*b*, the outer surface 126 of the separating member 122 also includes a projection 132 extending therefrom in a direction along a width 134 of the separating member 122. Further, the projection 132 may receive a resilient member 136. As can be seen from FIG. 2*a*, the resilient member 136 has a central hole 138 that allows the resilient member 136 to be disposed on the projection 132 of the separating member 122. An inner diameter 140 of the central hole 138 of the resilient member 136 is smaller than an outer diameter 142 of the projection 132 on which the resilient member 136 is capable of being disposed. This provides a tight fitting of the resilient member 136 on the projection 132. The outer surface 110 of the separating member 122 also has a groove 144 formed adjacent to the projection 132 that receives a portion of the resilient member 136 when the resilient member 136 is disposed on the projection 132.

In accordance with an embodiment of the present invention, the resilient member 136 is made of a material that has a higher coefficient of friction than material of the separating member 122. In one embodiment, the resilient member 136 is made from an elastomeric material, for example, rubber, while the separating member 122 is made from a plastic material. In another embodiment, the projection 132 may have an oval cross-section that receives the central hole 138 of the resilient member 136 thereon. Alternatively, the projection 132 may also have a circular cross-section. The resilient member 136 may be an O-shape ring that may be disposed on the projection 132.

FIGS. 1 and 3 also show a protruding portion 146, illustrated as a 'bump,' formed on the outer surface 126 of the separating member 122. The protruding portion 146 is formed substantially opposite to the projection 132 across the central opening 130 of the separating member 122 to engage a wiper 148, which is disposed adjacent to the charge roller 112. The wiper 148 has a top surface 150, a bottom surface 152, and a first edge 154, wherein a portion of the top surface 150 of the wiper 148, near the first edge 154, may engage the protruding portion 146 of the separating member 122. Further, within the printer cartridge 100, the top surface 150 of the wiper 148 also engages an outer surface of the charge roller 112. Furthermore, the wiper 148 also has a length 156 that is chosen in such a manner so as to allow the wiper 148 to extend beyond each of the separating members 126 rotatably mounted on the first end 116 and the second end of the charge roller shaft 114. In a similar manner, the separating member 122 that is rotatably mounted on the second end of the charge roller shaft 114 and having the protruding portion 146 may also engage the wiper 148. In one embodiment, the wiper 148 is made from an elastomeric material such as foam.

Further, as shown in FIG. 3, a bracket 158 supports the wiper 148 within the printer cartridge 100. The bracket 158 has an inner surface 160 that supports the bottom surface 152 of the wiper 148. Further, the inner surface 160 of the bracket 158 also has a doctor blade 162 attached thereto that engages the outer surface 110 of the photoconductive drum 102.

FIGS. 1 and 3 illustrate an arrangement of the separating member 122, which is mounted on the charge roller 112, engaged with the photoconductive drum 102 within the printer cartridge 100. The separating member 122 is rotatably mounted on the first end 116 of the charge roller shaft 114 in a first position 164. The first position 164, illustrated as a 'lift position,' of the separating member 122 refers to a position that allows the separating member 122 to engage the photoconductive drum 102 and lifts the charge roller 112 off the photoconductive drum 102. Further, in the first position 164, the resilient member 136 that is supported on the projection 132 engages a portion 166 of the outer surface 110 of the photoconductive drum 102. In an exemplary embodiment, the separating member 122 along with the resilient member 136 disposed thereon engages the outer surface 110 of the photoconductive drum 102 outside a printing area (not shown). This ensures that the contact made by the resilient member 136 on the outer surface 110 of the photoconductive drum 102 does not cause printing defects on a print medium (not shown) when the printer is operating.

Furthermore, the resilient member 136 is also designed to support the charge roller 112 load exerted on the photoconductive drum 102. In the embodiment of the printer cartridge 100 having the oval shape projection 132 and the resilient member 136 tightly disposed thereon, the resilient member 136 provides a larger footprint for the separating member 122 to contact the photoconductive drum 102. This larger footprint allows the resilient member 136 to support load of the charge roller 112 on the photoconductive drum 102.

Figure 4:
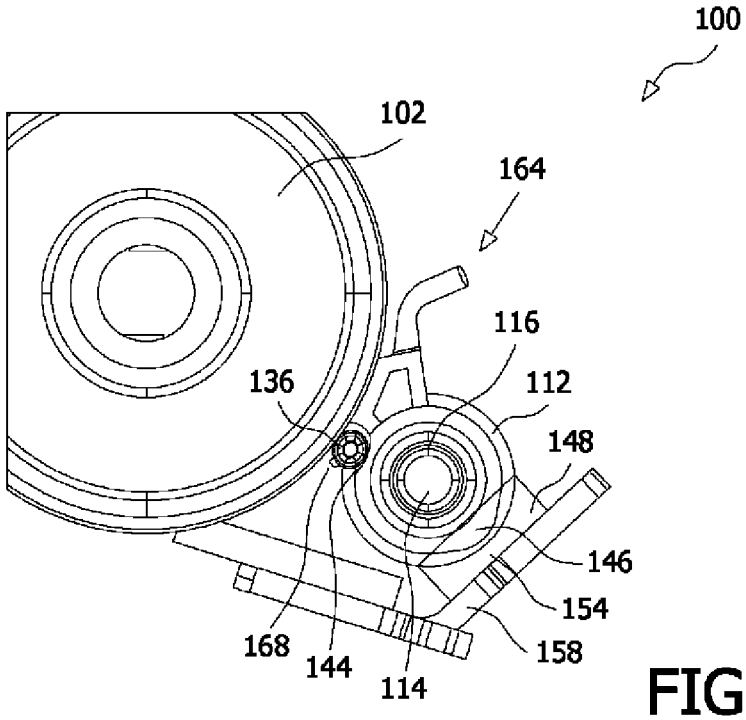
FIG. 4 is an elevational view of the separating member of FIG. 2*a* in the first position.

FIGS. 1, 3, and 4 illustrate the first position 164 of the separating member 122. In the first position 164, the separating member 122 lifts the charge roller 112 to a very small amount off the photoconductive drum 102. Due to this lifting of the charge roller 112, a gap 168 is created between the charge roller 112 and the photoconductive drum 102. The gap 168 prevents the charge roller 112 from contacting the outer surface 110 of the photoconductive drum 102. In an exemplary embodiment, the gap 168 between the charge roller 112 and the photoconductive drum 102 is no more than about 0.5 mm in order to reduce compression of the cleaning foam of the charge roller 112 during relatively long term storage, thereby improving cleaning effectiveness. Further, in the first position 164, the separating member 122, mounted on the first end 116 of the charge roller shaft 114, is designed to remain in the first position 164 so that the gap 168 between the charge roller 112 and the photoconductive drum 102 is always maintained.

As illustrated in FIG. 3, the wiper 148 that engages the protruding portion 146 of the separating member 122 exerts a reaction force $F_W$ on the separating member 122. Additionally, the charge roller shaft 114, which has the separating member 122 mounted thereto, also exerts a reaction force $F_S$ on the separating member 122. Further, as the resilient member 136 of the separating member 122 engages the portion 166 of the photoconductive drum 102, the resultant of the reaction forces $F_W$ and $F_S$ allow the resilient member 136 to exert a loading force on the portion 166. At this portion 166, an equal reaction force $R_{PC}$, opposite to the direction of the resultant of reaction forces $F_W$ and $F_S$, is also exerted by the photoconductive drum 102 on the resilient member 136. FIG. 3 also illustrates that the resultant of forces $F_W$ and $F_S$ act along the centerline 120 of the charge roller shaft 114 while the reaction force $R_{PC}$ acts along the centerline 108 of the photoconductive drum 102.

As shown in FIG. 1, both the centerlines 108, 120 are offset by a predetermined distance'd'. Thus, as illustrated from FIG. 3, the resultant of forces $F_W$ and $F_S$ do not act along the line of action of the reaction force $R_{PC}$. Rather, the resultant force is also offset by the predetermined distance'd' from the line of action of the force $R_{PC}$. Since the resilient member 136 engages the photoconductive drum 102, the offset distance'd' allows the reaction force $R_{PC}$ to exert a counterclockwise torque on the separating member 122.

Figure 5:
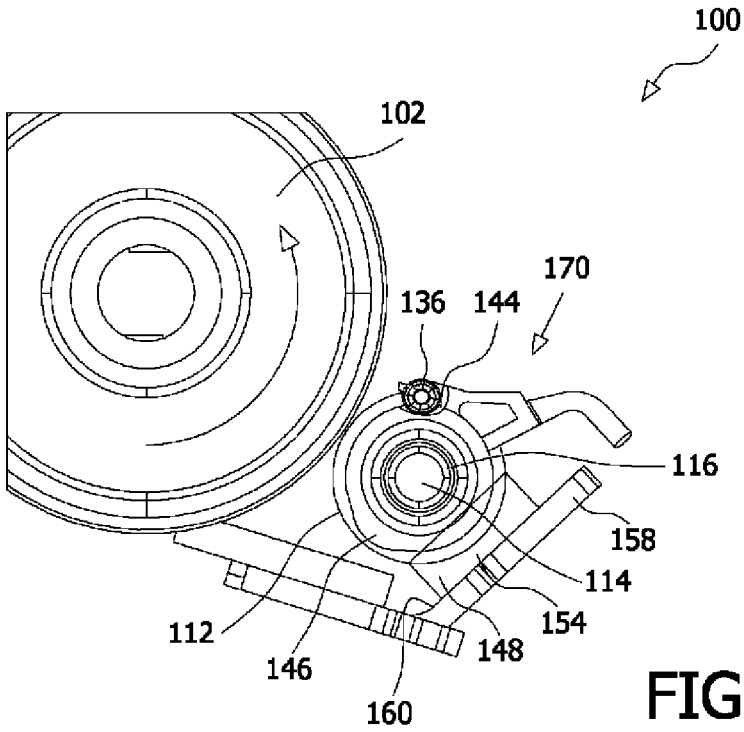
FIG. 5 is an elevational view of the separating member of FIG. 2*a* in a second position.

Further, in the first position 164, the separating member 122 is also acted upon by forces like gravitational force or vibration force that may have a tendency to rotatably move the separating member 122 to a second position 170. These forces may act on the printer cartridge 100 when the aftermarket units are stored for months, or during shipment of the aftermarket units. The second position 170 is illustrated in FIG. 5 as "drop position." In the second position 170, the separating member 122 is disengaged from the photoconductive drum 102 thereby allowing the charge roller 112 to drop towards the photoconductive drum 102. This dropping of the charge roller 112 engages the charge roller 112 with the photoconductive drum 102.

However, such rotation of the separating member 122 to the second position 170 is prevented by the counterclockwise torque exerted by the reaction force $R_{PC}$, as illustrated in FIG. 3. In addition, such rotation of the separating member 122 to the second position 170 is also prevented by the protruding portion 146 of the separating member 122, which as mentioned above, engages the top surface 150 of the wiper 148. Due to this engagement, the top surface 150 of the wiper 148 exerts a frictional force $f_{FW}$ in a direction opposite to the movement of the separating member 122 in the second position 170. Thus, both the counterclockwise torques exerted by the reaction force $R_{PC}$ and the frictional force $f_{FW}$ prevent the separating member 122 from moving to the second position 170. Thus, under any scenario, the separating member 122 always remains engaged with the photoconductive drum 102 in the first position 164.

The printer cartridge 100 is electrically connected to a power source (not shown) and a drive source (not shown) within the image forming device. On first usage of the printer cartridge 100 within the image forming device, the separating member 122 rotatably moves to the second position 170. In the second position 170, the separating member 122 is disengaged from the photoconductive drum 102 to allow the charge roller 112 to engage the photoconductive drum 102. FIG. 5 illustrates one such second position 170 of the separating member 122.

FIG. 5 illustrates a rotating photoconductive drum 102 during the first usage of the printer cartridge 100. As the resilient member 136 is engaged with the portion 166 of the photoconductive drum 102, rotation of the photoconductive drum 102 generates a very high frictional force on the resilient member 136. This frictional force exerts a clockwise rotational torque on the resilient member 136 that has a greater magnitude than the combination of counter-clockwise torques exerted by the reaction force $R_{PC}$ and frictional force $f_{FW}$. Due to this clockwise rotational torque exerted on the resilient member 136, the resilient member 136 transfers this rotational torque to the separating member 122 thereby allowing the separating member 122 to move to the second position 170. This rotation of the separating member 122, to the second position 170, allows the charge roller 112 to drop towards the photoconductive drum 102 thereby allowing engagement therebetween. Thus, a user may not need to manually push the separating member 122 to the second position 170 as the separating member 122 automatically moves to the second position 170 on the first usage of the printer cartridge 100.

Further, as shown in FIGS. 1, 2*a*, and 2*b*, the separating member 122 has an arm 172 that may be formed on the outer surface of the separating member 122. The arm 172 may be formed adjacent to the projection 132 of the separating member 122. The arm 172 may be used to manually rotate the separating member 122 between the first position and the second position 170. Further, as shown in FIG. 5, the arm 172 of the separating member 122 may engage one of lateral sides of the bracket 158. Since the separating member 122 is free to rotate within the charge roller shaft 114 from the first position 164 to the second position 170, the arm 172 that engages one of the lateral sides of the bracket 158 also serves to restrain rotational motion of the separating member 122 beyond the second position 170. Thus, during the printing operation, the separating member 122 remains in the second position 170 while the charge roller shaft 114 rotates therein.

Figure 6:
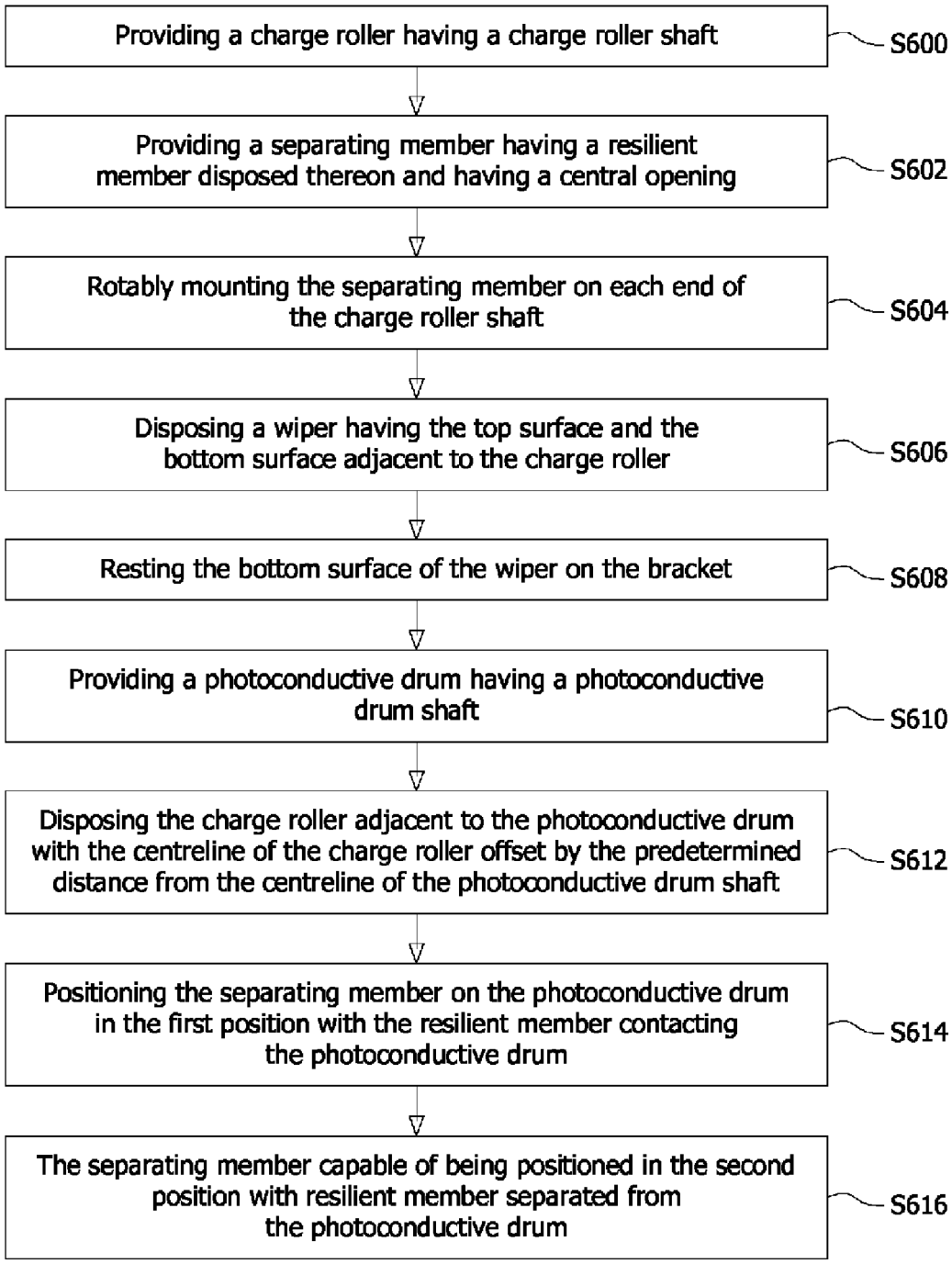
FIG. 6 is a flow diagram illustrating the steps showing relationship between the separating member, the charge roller, and the photoconductive drum in the first position and the second position of the separating member.

In another embodiment, as illustrated in a flowchart of FIG. 6, a method for separating the charge roller 112 and the photoconductive drum 102 within the printer cartridge 100 according to the present invention is disclosed. Within the printer cartridge 100, the charge roller 112 is provided (Step S600). The charge roller 112 has the charge roller shaft 114 that may rotate about the rotational axis 118. The charge roller shaft 114 also has the centerline 120 that is orthogonal to the rotational axis 118. On each of the first end 116 and the second end of the charge roller shaft 114 the separating member 122 is rotatably mounted. The separating member 122 includes the inner surface 124, the outer surface 126, the central opening 130, and the resilient member disposed on the outer surface 126 of the separating member 122 (Step S602). The central opening 130 of the separating member 122 receives the charge roller shaft 114 in such a manner so as to allow the separating member 122 to be rotatably mounted on the charge roller shaft 114 (Step S604). Further, the charge roller shaft 114 freely rotates within the central opening 130 of the separating member 122.

The wiper 148 that has the top surface 150 and the bottom surface 152 may also be provided within the printer cartridge 100. The wiper 148 may be disposed adjacent to the charge roller 112 with the top surface 150 of the wiper 148 engaging the charge roller 112 (Step S606). The bracket 158 supports the wiper 148 within the printer cartridge 100. The bracket 158 has the inner surface 160 on which the bottom surface 152 of the wiper 148 rests (Step S608).

The photoconductive drum 102 is also disposed within the printer cartridge 100. The photoconductive drum 102 receives the photoconductive drum shaft 104 therein that rotates about the rotational axis 106 (Step S610). The photoconductive drum shaft 104 also has the centerline 108 orthogonal to the rotational axis 106. Further, the photoconductive drum 102 is disposed adjacent to the charge roller 112 with the centerline 120 of the charge roller shaft 114 offset by the predetermined distance'd' from the centerline 108 of the photoconductive drum shaft 104 (Step S612).

Thereafter, the separating member 122 is positioned in the first position 164 to lift the charge roller 112 away from the photoconductive drum 102. Due to this lifting of the charge roller 112, the gap 168 is created between the charge roller 112 and the photoconductive drum 102. Further, in the first position 164, the resilient member 136 contacts the portion 166 of the photoconductive drum 102 (Step S614). Due to this contact of the resilient member 136, the resilient member 136 supports the charge roller 112 load exerted on the photoconductive drum 102. Further, as noted above, the predetermined offset distance between both the centerlines 108, 120 creates a counterclockwise torque that retains the separating member 122 in the first position 164. Furthermore, due to the engagement of the wiper 148 with the protruding portion 146 of the separating member 122, an additional counterclockwise torque is also exerted on the separating member 122 to retain the separating member 122 in the first position 164.

The printer cartridge 100 may be disposed within the image forming device. On first usage of the printer cartridge 100, the photoconductive drum 102 starts to rotate. Rotation of the photoconductive drum 102 exerts a separating force on the resilient member 136 thereby moving the separating member 122 to the second position 170. In the second position 170, the resilient member 136 gets separated from the photoconductive drum 102 and the separating member 122 gets disengaged from the photoconductive drum 102 (Step S616). Further, in the second position 170 of the separating member 122, the charge roller 112 drops towards the photoconductive drum 102 to get engaged with the photoconductive drum 102.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. A unit for an image forming device comprising:

a photoconductive drum disposed within the unit and having a shaft that rotates about a rotational axis and a centerline orthogonal to the rotational axis of the shaft;

a charge roller having a shaft that rotates about a rotational axis and a centerline orthogonal to the rotational axis of the shaft, the charge roller disposed adjacent to the photoconductive drum in an orientation that includes the centerline of the charge roller offset by a predetermined nonzero distance from the centerline of the photoconductive drum; and a separating member rotatably disposed on each end of the charge roller shaft and having a resilient member disposed thereon, the separating member engaging the photoconductive drum in a first position to provide a spaced relationship between the charge roller and the photoconductive drum and the separating member disengaging the photoconductive drum in a second position to engage the charge roller with the photoconductive drum, the resilient member contacting a portion of the photoconductive drum in the first position and being separated from the photoconductive drum in the second position, the separating member further comprising:

a projection extending from an outer surface, the projection receiving at least a portion of the resilient member; and a central opening for receiving an end of the char e roller shaft wherein the shaft is free to rotate within the central opening.

2. The unit according to claim 1, wherein the projection has a substantially oval or circular shaped cross-section.

3. The unit according to claim 2, wherein the resilient member has an opening for being received on the projection.

4. The unit according to claim 1, further comprising a wiper having a top surface and a bottom surface and disposed adjacent the charge roller, wherein the top surface engages the charge roller along a length thereof and the bottom surface supported over at least a portion of a mounting bracket.

5. The unit according to claim 4, the separating member further including an outer surface having a protruding portion and disposed adjacent to the wiper, wherein the protruding portion engages a portion of the top surface of the wiper in the first position of the separating member and disengages from the top surface in the second position.

6. A unit for an image forming device comprising:

a photoconductive drum disposed within the unit and having a shaft that rotates about a rotational axis and a centerline orthogonal to the rotational axis of the shaft;

a charge roller having a shaft that rotates about a rotational axis and a centerline orthogonal to the rotational axis of the shaft, the charge roller disposed adjacent to the photoconductive drum in an orientation that includes the centerline of the charge roller offset by a predetermined nonzero distance from the centerline of the photoconductive drum; and a separating member rotatably disposed on each end of the charge roller shaft and having a resilient member disposed thereon, the separating member engaging the photoconductive drum in a first position to provide a spaced relationship between the charge roller and the photoconductive drum and the separating member disengaging the photoconductive drum in a second position to engage the charge roller with the photoconductive drum, the resilient member contacting a portion of the photoconductive drum in the first position and being separated from the photoconductive drum in the second position;

wherein the resilient member is an o-shaped ring and the separating member is a cam.

7. The unit of claim 6, wherein the o-shaped ring is made of a material that has a greater friction than a material of the cam.

8. A method for separating a charge roller and a photoconductive drum within a unit for a printer comprising:

providing a charge roller having a shaft that rotates about a rotational axis and a centerline orthogonal to the rotational axis;

disposing a rotatable separating member having an outer surface for retaining a resilient member on each end of the charge roller shaft;

disposing a photoconductive drum having a shaft that rotates about a rotational axis and a centerline orthogonal to the rotational axis, the photoconductive drum disposed adjacent to the charge roller in an orientation that includes the centerline of the charge roller shaft offset by a predetermined nonzero distance from the centerline of the photoconductive drum shaft;

positioning the separating member on the photoconductive drum in a first position to provide a spaced relationship between the charge roller and the photoconductive drum with the resilient member contacting a portion of the photoconductive drum, the resilient member capable of being separated from the photoconductive drum by positioning the separating member in a second position, the second position engaging the charge roller with the photoconductive drum; and extending a projection of a substantially oval or circular shaped cross section from the outer surface of the separating member for receiving the resilient member.

9. The method according to claim 8, further including providing a central opening within the separating member for receiving an end of the charge roller shaft, wherein the shaft rotates freely within the central opening.

10. The method according to claim 8, further including disposing a wiper having a top surface adjacent the charge roller, wherein the top surface engages the charge roller along a length thereof.

11. The method according to claim 10, the outer surface of the separating member further including a protruding portion disposed opposite to the resilient member, the protruding portion engaging a portion of the top surface of the wiper in the first position of the separating member and capable of being disengaged from the top surface in the second position.

12. The method according to claim 10, further comprising disposing a mounting bracket below the wiper, wherein a bottom surface of the wiper is supported over the mounting bracket.

13. The method according to claim 8, wherein a first rotation of the photoconductive drum allows the resilient member to turn the separating member to the second position.

14. A separating member for separating a photoconductive drum and a charge roller in a unit for a printer comprising:

a central opening for receiving a charge roller shaft, the charge roller shaft disposed to freely rotate within the central opening;

an outer surface disposed at a distance and around the central opening, the outer surface including a projection extending from the outer surface and having a protruding portion oppositely disposed to the projection; and a resilient member disposed on the projection and capable of contacting the photoconductive drum in a first position of the separating member, the first position capable of providing a spaced relationship between the photoconductive drum and the charge roller.

15. The separating member according to claim 14, wherein the separating member is disposed at each end of the charge roller shaft and movable from the first position to a second position.

16. The separating member according to claim 15, wherein the separating member is disposed in the second position to engage the charge roller with the photoconductive drum.

17. The separating member according to claim 14, wherein the protruding portion is disposed adjacent to a wiper and is in contact with a top surface thereof.

18. The separating member according to claim 14, wherein the projection has a substantially oval or circular shaped cross-section.

19. The separating member according to claim 14, wherein the separating member is a cam and the resilient member is an o-shaped ring.

20. A unit for an image forming device comprising:

a photoconductive drum disposed within the unit and having a shaft that rotates about a rotational axis and a centerline orthogonal to the rotational axis of the shaft;

a charge roller having a shaft that rotates about a rotational axis and a centerline orthogonal to the rotational axis of the shaft, the charge roller disposed adjacent to the photoconductive drum in an orientation that includes the centerline of the charge roller offset by a predetermined nonzero distance from the centerline of the photoconductive drum;

a separating member rotatably disposed on each end of the charge roller shaft and having a resilient member disposed thereon, the separating member engaging the photoconductive drum in a first position to provide a spaced relationship between the charge roller and the photoconductive drum and the separating member disengaging the photoconductive drum in a second position to engage the charge roller with the photoconductive drum, the resilient member contacting a portion of the photoconductive drum in the first position and being separated from the photoconductive drum in the second position; and a wiper having a top surface and a bottom surface and disposed adjacent the charge roller, wherein the top surface engages the charge roller along a length thereof and the bottom surface supported over at least a portion of a mounting bracket;

the separating member further including an outer surface having a protruding portion and disposed adjacent to the wiper, wherein the protruding portion engages a portion of the top surface of the wiper in the first position of the separating member and disengages from the top surface in the second position.

21. A method for separating a charge roller and a photoconductive drum within a unit for a printer comprising:

providing a charge roller having a shaft that rotates about a rotational axis and a centerline orthogonal to the rotational axis;

disposing a rotatable separating member having an outer surface for retaining a resilient member on each end of the charge roller shaft;

disposing a photoconductive drum having a shaft that rotates about a rotational axis and a centerline orthogonal to the rotational axis, the photoconductive drum disposed adjacent to the charge roller in an orientation that includes the centerline of the charge roller shaft offset by a predetermined nonzero distance from the centerline of the photoconductive drum shaft;

positioning the separating member on the photoconductive drum in a first position to provide a spaced relationship between the charge roller and the photoconductive drum with the resilient member contacting a portion of the photoconductive drum, the resilient member capable of being separated from the photoconductive drum by positioning the separating member in a second position, the second position engaging the charge roller with the photoconductive drum; and disposing a wiper having a top surface adjacent the charge roller, wherein the top surface engages the charge roller along a length thereof;

the outer surface of the separating member further including a protruding portion disposed opposite to the resilient member, the protruding portion engaging a portion of the top surface of the wiper in the first position of the separating member and capable of being disengaged from the top surface in the second position.

* * * * *